United States Patent [19]

Lents

[11] Patent Number: 4,875,622

[45] Date of Patent: Oct. 24, 1989

[54] BREAKAWAY FREESTANDING ROADSIDE STRUCTURE AND METHOD FOR CONSTRUCTION THEREOF

[75] Inventor: Rollie T. Lents, Orlando, Fla.

[73] Assignee: James A. Waddell, Orlando, Fla.

[21] Appl. No.: 210,753

[22] Filed: Jun. 23, 1988

[51] Int. Cl.[4] ..... B65D 91/00

[52] U.S. Cl. ..... 232/39; 52/314; 256/19

[58] Field of Search ..... 232/39, 17; 256/19, 256/59; 52/316, 314, 309.12, 726

[56] References Cited

U.S. PATENT DOCUMENTS

| | | | |
|---|---|---|---|
| 3,521,862 | 7/1970 | Curtner | 256/19 X |
| 3,892,387 | 7/1975 | Mann | 256/19 X |
| 4,142,711 | 3/1979 | Brimhall | 256/19 X |
| 4,422,269 | 12/1983 | Giard | 52/314 X |
| 4,588,123 | 5/1986 | Plew | 232/39 |
| 4,686,807 | 8/1987 | Newsome | 52/314 |

*Primary Examiner*—Robert W. Gibson, Jr.
*Attorney, Agent, or Firm*—Warren L. Franz

[57] ABSTRACT

A breakaway freestanding roadside structure in the form of a curbside brick mailbox is formed from a block of styrofoam, coated with successive layers of a mixture of stucco and lightweight aggregate filler, into a cutout of which a standard rural delivery mailbox fixture is placed. A wet outer coating layer is recessed down to a partially dug inner layer to simulate brickwork, the outer layer being shaped and colored to resemble the faces of brick, stone or other masonry elements and the inner layer being colored so that portions expressed by the recesses resemble intervening mortar joints. A mailbox flag is secured by an extended rod through the block to the interior of the mailbox. Modified embodiments take the form of planters, entranceways and fence posts.

20 Claims, 2 Drawing Sheets

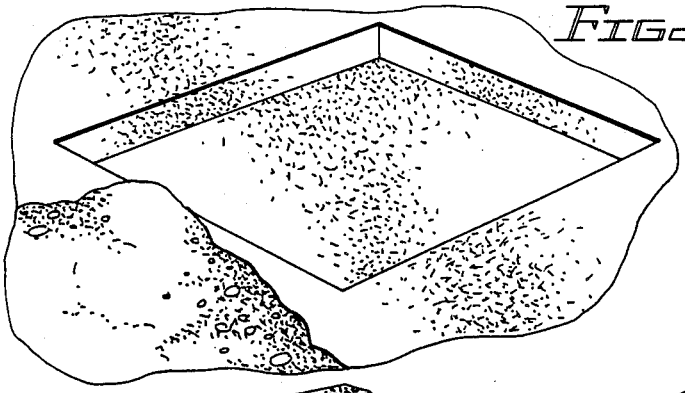
FIG. 1G
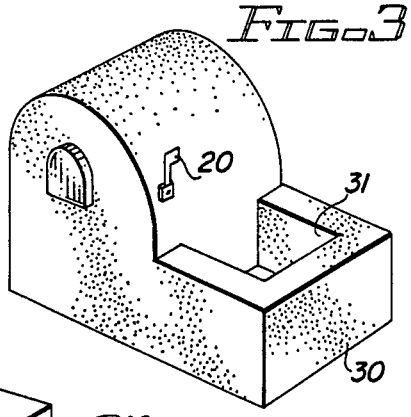
FIG. 3
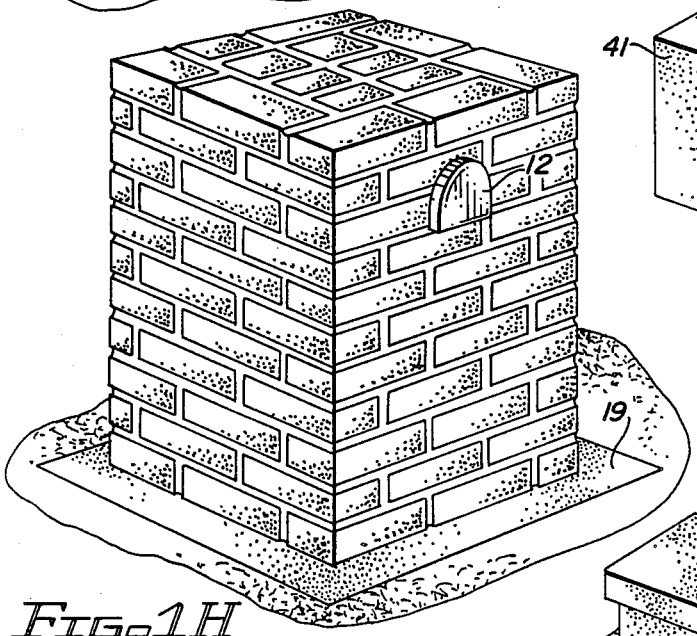
FIG. 1H
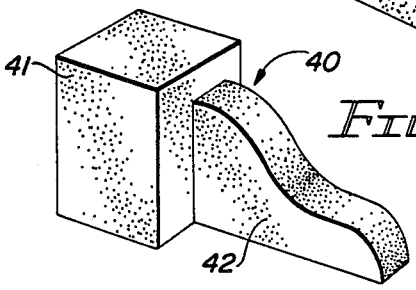
FIG. 4
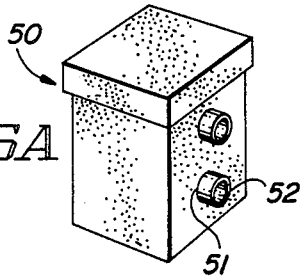
FIG. 5A
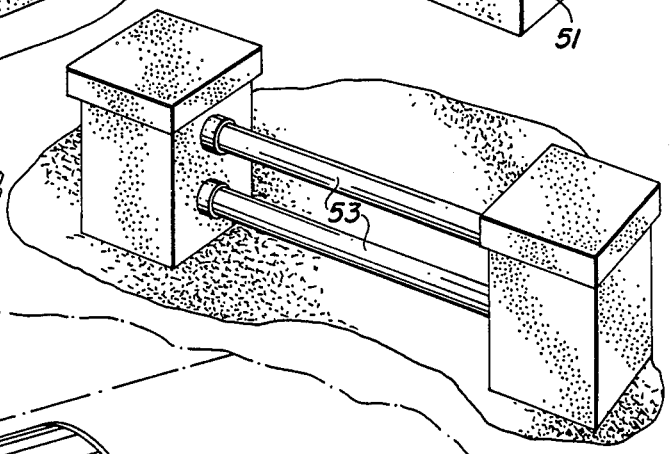
FIG. 5B
FIG. 2
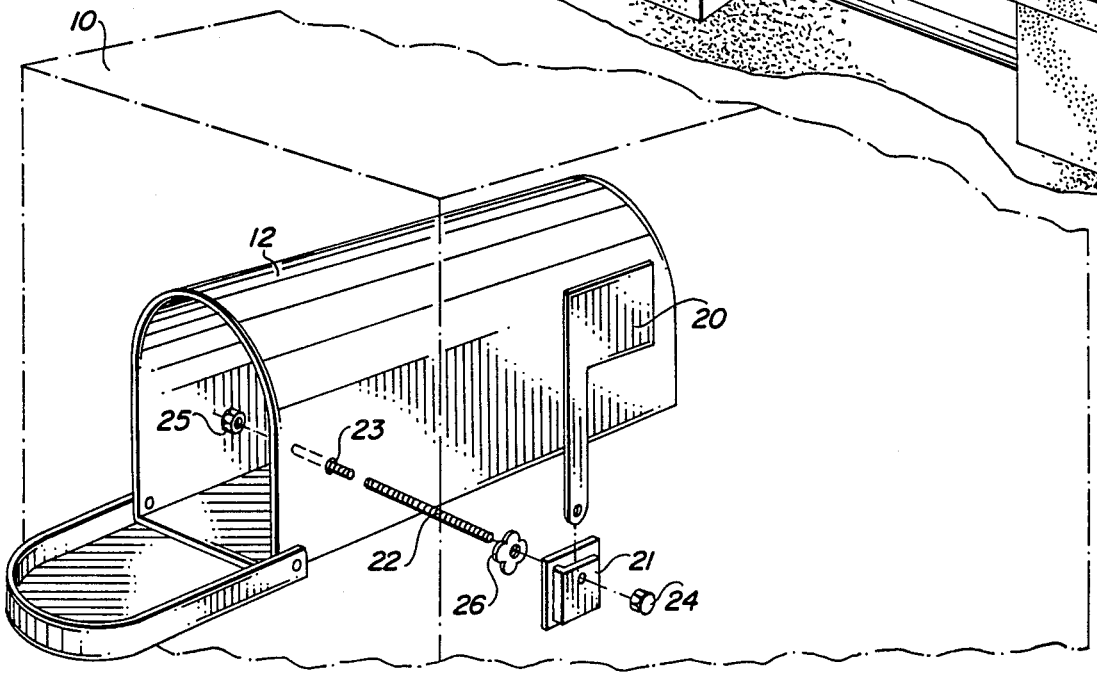

BREAKAWAY FREESTANDING ROADSIDE STRUCTURE AND METHOD FOR CONSTRUCTION THEREOF

This invention relates to freestanding roadside structures, such as curbside stone or brick mailbox structures, and methods for making the same.

BACKGROUND OF THE INVENTION

Freestanding structures of the type to which the present invention relates include entranceways, fence posts, mailboxes and similar structures typically found curbside and elsewhere on street rights-of-way. In recent years, there has been a proliferation especially of immovable roadside mailboxes which are a hazard to motorists and quite frequently violate building codes and local ordinances.

Roadside mailbox structures of brick, stone, concrete block and the like have an aesthetic appeal in that they provide a pleasing structure that comports with the color, texture and appearance of the house or other main structure with which they are associated. In a usual construction, such roadside mailboxes may be built up of solid bricks or stones, or may be fabricated by erecting a wood or concrete block substructure in situ which is covered with a brick, stone or other masonry facade.

Such structures present a serious safety hazard when struck by vehicles. When hit they are either totally immovable, giving the effect of crashing into a solid wall, or else the constituents thereof become dangerous projectiles that can cause secondary injuries beyond the impact with the structure itself. There are also structural problems with such structures. Uneven ground shifting causes premature and unsightly cracking, with individual bricks or other building elements sometimes becoming dislodged and ending up in the roadway. The mail signal flag also comes loose or falls out because it has not been securely fastened to the hard materials.

Immovable roadside structures continue to be built despite local prohibitions against their construction on street rights-of-way and despite state and federal road guidelines that require that they break off without serious damage to a vehicle when hit.

SUMMARY OF THE INVENTION

It is an object of the present invention to overcome the above and other drawbacks of the prior art by providing a breakaway freestanding roadside structure formed of a block of rigid lightweight shape-giving material to which a decorative coating material is applied to comport with the external appearance of an associated main structure.

In one aspect of the invention, discussed in greater detail below, a roadside mailbox is provided having a preformed block of rigid lightweight plastic foam material covered with one or more coatings of cementitious material and a mailbox secured within a cutout thereof.

In another aspect of the invention a method for construction of a roadside structure is provided in which a form giving preformed block of rigid lightweight plastic foam material is covered with coatings of cementitious material in a manner that permits recesses to be formed, texturing to be given, and coloring to be added so as to closely match and simulate the external stone, brick or other masonry appearance of an associated main structure.

In preferred embodiments, discussed in greater detail below, the structure and method of the invention utilizes preformed blocks of styrofoam which are covered with layers of stucco shaped to give the desired texture and appearance, and to one or more of which coloring pigmentation is added. In a described mailbox embodiment, a flag is secured by extending a fastener from the outside of the structure all the way through to the inside of a mailbox received in a cutout therein.

BRIEF DESCRIPTION OF THE DRAWINGS

Embodiments of the invention have been chosen for purposes of illustration and description, and are shown in the accompanying drawings, wherein:

FIGS. 1A–1H are views, including partial sections, of the steps of the method of the invention, with the structure of the invention formed as a product thereof;

FIG. 2 an exploded view of one step in an embodiment of the method of FIG. 1;

FIG. 3 is a view of a planter mailbox form of the invention;

FIG. 4 is a view of an entranceway post version of the invention, and

FIGS. 5A–5B show a fence post version of the invention.

Throughout the drawings, like elements are referred to by like numerals.

DESCRIPTION OF THE PREFERRED EMBODIMENTS

FIGS. 1A–1H show the construction of a breakaway freestanding roadside structure in accordance with the invention, in the form of a brick mailbox for curbside installation.

A preformed block 10 of rigid lightweight plastic foam material, preferably styrofoam, is provided with a cutout 11 opening onto a front surface thereof and into which a standard aluminum rural delivery mailbox fixture 12 (FIGS. 1A and 1B) is inserted.

The block 10 serves to establish the shape of the end mailbox structure and is chosen accordingly. The embodiment illustrated in FIGS. 1A–1H utilizes a block 10 of parallelpiped configuration having a height of 42"–48" and a flat 18"×18" square top and base. Other possible configurations include a top which is rounded, cascaded or pagoda-shaped. The cutout 11 can easily be achieved using conventional plastic foam material cutting means, such as a hot wire cutting tool. Undesired openings, such as a cutout access line 13 (FIG. 1A), are covered with commercially available fiberglass mesh tape, or other patching substance. The cutout is dimensioned to tightly envelop the mailbox, with just enough of the front of the mailbox left out (about 1") to permit the opening of the box lid for mail insertion and retrieval. The box may be secured within the cutout using an adhesive, such as a silicon elastomer.

Figure 1A:
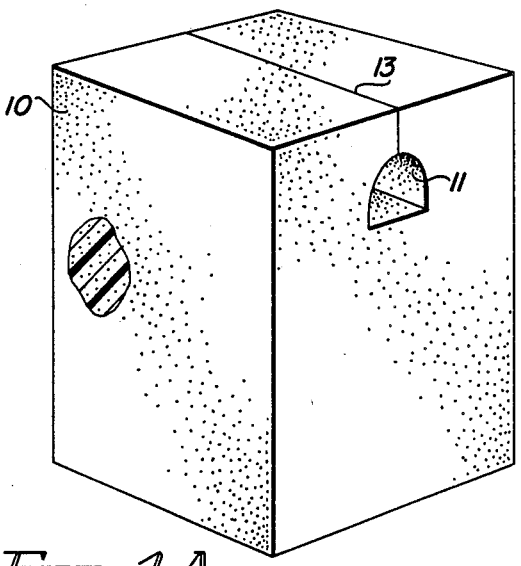
Figure 1D:
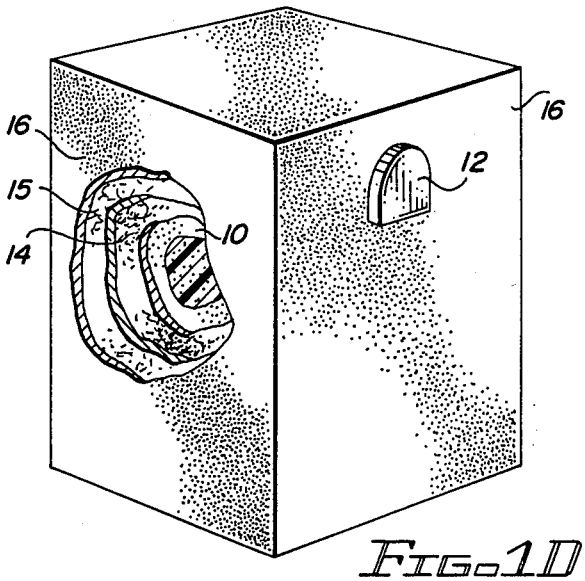
Figure 1B:
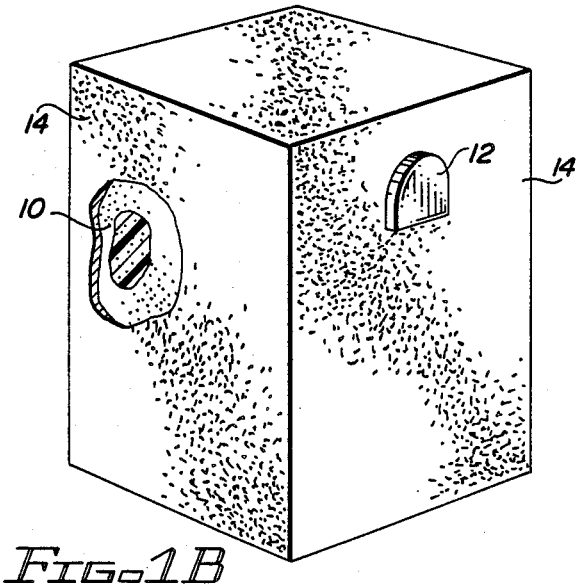

With the fixture 12 in place in the cutout 11, a first scratch coat of masonry stucco material is hand-troweled with a masonry trowel evenly over the entire exposed outside of the block 10 to form a coating 14, which is allowed to dry completely (FIG. 1B). A ⅛" to ¼" thickness of coating 14 is suggested, with a drying time of one to three days depending on air moisture conditions. A second thicker coating 15 of stucco, to which coloring material has been added, is then applied over the first coat 14 and allowed to partially dry (FIG. 1C). A third coating 16, also to which coloring material has been added is then applied over the second coat 15 after a few hours when the second coat has not yet completely dried (FIG. 1D). The third coat, while wet, is then hand cut (FIG. 1E) to simulate individual bricks by introducing horizontal and vertical recesses 17, 18 thereto which extend down into the second layer 16. The cuts can be made with the assistance of shapers, templates or similar implements. The coloring material (which may take the form of cement color pigments such as available commercially from Lambert Davis, for example) added to the second coating 14 serves to establish the color of the simulated mortar joint lines between the bricks. The color of the third coating 16 establishes the basic brick color. The outer coating 16 can be shaped, marked, scored, etc. as desired to give the texture of the brick runs to be simulated, i.e. rough brick, Chicago brick, etc. External coloring can be brush painted on the outer surface of coating 16 at this stage, or later after the structure has been set in its end use position, to more closely match the appearance of actual brick.

Although the coatings 14, 15, and 16 are preferably of stucco, as described, other cementitious coating materials are also possible that will adhere to the block 10 and give the desired appearance. Also, while the simulation of brickwork has been described, block, stone or other building facades (plain stucco, coral, wood, etc.) can be simulated by selection of appropriate color additives and corresponding differences in recess shaping and texture. The second and third coatings 15, 16 are applied in appropriate depths depending on the surface to be simulated. Simulation of a Tennessee rock exterior will, for example, require a much thicker outer coat 16, with recesses 17, 18 formed as wandering paths and the islands left between the recesses being contoured to resemble rock faces. A total thickness "A" (FIG. 1E) can typically be ½" for a plain unrecessed stucco effect, ¾" for simulated brick, and 2 ½ for stone simulation.

To keep the total weight of the fabricated structure down, the stucco used for the coatings 14, 15, 16 may advantageously be mixed with a lightweight aggregate material. A 50:50 mixture of commercially available Permalite TM plaster/tile aggregate filler material added to the stucco has been found appropriate. Using such a mixture for successively coating a block 10 of styrofoam material of about 10 pounds weight, a total end structure weight of 75 to 100 pounds is achieved.

Figure 1E:
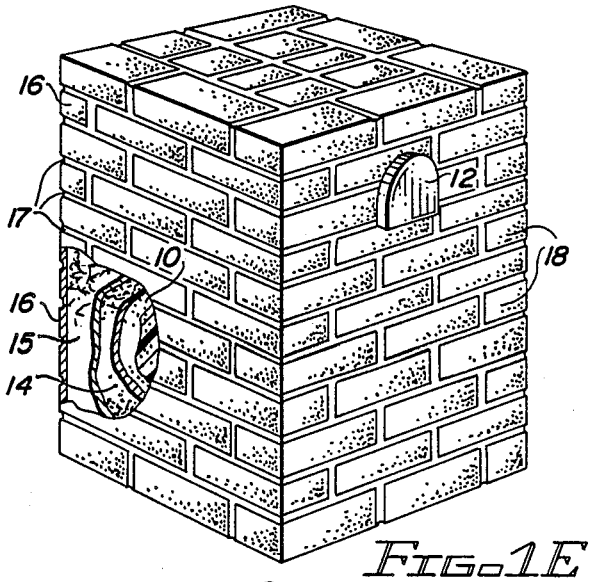
Figure 1C:
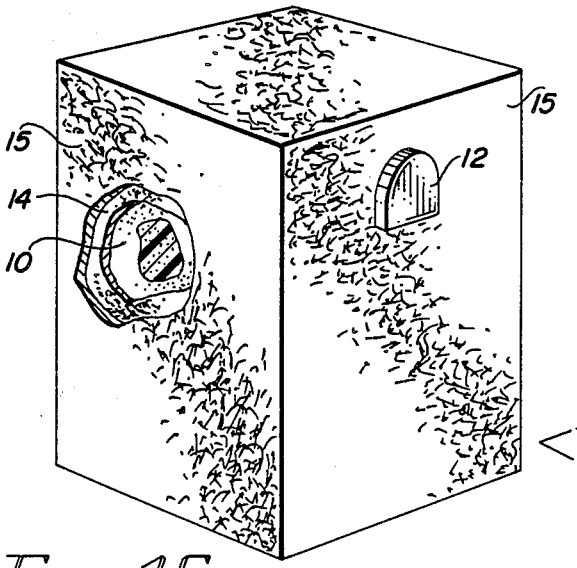
Figure 1F:
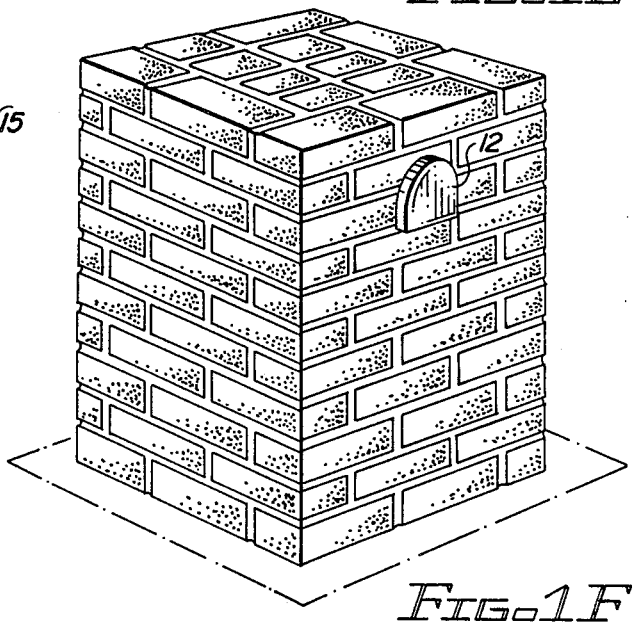

FIG. 1E illustrates the freestanding structure of the invention which is fabricated in accordance with the described method. The finished structure is of lightweight material and can be conveniently delivered to a roadside location for installation. A preferred installation method is illustrated by the steps shown in FIGS. 1F–1H. The structure is set on the ground at the desired location and a boundary is marked extending 4" from the edge of the structure base, as shown. The structure is then removed and the ground dug out in the marked area to a depth of 4" (FIG. 1G). The structure is then again set down in centered position within the dug out hole and a concrete collar 19 is poured in the marginal region between the edge of the structure and the edge of the hole (FIG. 1H). If the climate so requires, the concrete collar can be replaced by a collar in the form of an expansion joint pad. Final color matching of the exterior of the structure to the exterior of an associated house or the like can be done after installation by painting additional pigmentation marks over the top layer 16.

At a convenient point in the assembly or installation process, a mail flag 20 is added to the mailbox structure, as shown in FIG. 2. This is preferably done after completion and shaping of the third coating 16 but before delivery to the installation site. The flag 20 is placed in position within a slotted flag bracket 21 which is brought flush against one side of the coated block 10. A piece of threaded rod 22 of suitable length is then run through the bracket 21 and flag 20, through the block 10 from the exterior of the structure to the mailbox 11, and through an aperture 23 in the wall of the box 13 to the interior of the box. The rod is secured by a cap nut 24, fitted onto its bracket 21 end and a flat nut 25 threaded at its mailbox 11 end. A plastic spider washer 26 is positioned between the bracket 21 and the third coating 16.

The flag mounting arrangement, except for the extensive rod 22, is essentially the same as the arrangement for direct mounting of a flag on a mailbox 12 which is placed on a roadside post mounting, and utilizes the same parts. The extended rod 22 offers an improvement over conventional methods of mounting flags to immovable brick mailbox structures, because such mountings do not connect the flag all the way through the brick to the box. This leads to the flags becoming dislodged because they come loose from the brickwork, and makes replacement of a broken flag mechanism difficult. With the direct mounting connection between the flag and the mailbox insert 12 contemplated by the present invention, as shown in FIG. 2, both installation and replacement are facilitated. The rod 22 is preferably heated for ease in poking it through the styrofoam to the mailbox aperture 23.

FIG. 3 shows a version of a mailbox similar to that produced by the method described in connection with FIGS. 1A–1H, to which a planter 30 including an upper cutout 31 has been added. The planter form 30, which is preferably of the same preformed block material as the form 32 of the mailbox form proper, is attached by means of silicon elastomer or other suitable adhesive to the main mailbox structure at the FIG. 1A step in construction. (The main mailbox structure of FIG. 3 has a rounded top in contrast to the flat top previously described.) Stucco coatings are then successively added and installation proceeds as discussed with respect to FIGS. 1B–1H.

FIG. 4 illustrates a roadside structure in accordance with the invention having the same breakaway feature and taking the form of an entranceway post 40. The post is divided into two blocks 41, 42 which are secured together in known ways at a first construction step (i.e. as in FIG. 1A.) The first block 41 has a generally parallelpiped shape, and the second block 42 has an elongated, tapered shape. Coatings are added to the joined blocks and the same are installed at a roadside location in accordance with a method similar to that of FIGS. 1B–1H.

The embodiment of breakway freestanding structure shown in FIGS. 5A–5B takes the form of a fence post 50 which has the same preformed block structure as previously described. Here, However, cutouts take the form of circular openings 51 which extend horizontally all the way through the block structure. The openings are lined with PVC pipe protectors 52 which adhere with silicon elastomer or other material to the block and protect the block from PVC, wooden or other rails 53 which can be added to extend between fence posts. FIG. 5B illustrates fence posts in which the cutouts extend only partially through the block to serve as end posts. In another embodiment (not shown), PVC tubing can be inserted within channels in the styrofoam to provide conduits for electric wiring for the addition of lighting fixtures, etc.

Embodiments of the structure of the invention constructed and installed in accordance with the above described method provide a breakaway freestanding roadside structure with significant advantages over immovable prior art structures. Should a vehicle collide with the structure, the structure will break free of the collar and be moved in one piece, causing relatively little damage to the driver. The structure is lightweight, easily constructed and readily conformable to the external appearance of an associated main structure. The unity and integrity of the finished structure avoids the disparate shifting experienced by the prior art immovable structures that causes cracks and dislodging of materials. The selection of polystyrene as the preferred shape forming material provides an inert, mildew and rot resistant substructure that is readily formable and easy to work with. The choice of a stucco-aggregate mixture for the cementitious coating material likewise provides an easily utilized, readily available, durable substance.

Those skilled in the art to which the present invention relates will recognize that various substitutions and modifications may be made to the illustrative embodiments, without departing from the spirit and scope of the present invention as defined by the claims appended hereto, and such variations are intended to be covered hereby.

What is claimed is:

1. A breakaway freestanding roadside structure, comprising:

a preformed block of rigid lightweight plastic foam material having a cutout therein;

one or more coatings of cementitious material applied to the outside of said block;

a mailbox secured within said cutout.

2. A structure as in claim 1, wherein said foam material is styrofoam.

3. A structure as in claim 2, wherein said cementitious material comprises stucco.

4. A structure as in claim 3, wherein said cementitious material comprises a mixture of stucco and lightweight aggregate filler material.

5. A structure as in claim 3, wherein said one or more coatings comprise an outer coating shaped and colored to simulate the appearance of a plurality of discrete masonry building construction elements, and an inner coating having portions exposed through said outer coating shaped and colored to simulate the appearance of a substance used to bind said discrete elements.

6. A structure as in claim 5, wherein said outer coating is shaped and colored to simulate a plurality of bricks and wherein said inner coating is shaped and colored to simulate mortar joints between said bricks.

7. A structure as in claim 1, further comprising a mail flag mounted to said mailbox by a rod that extends through the block into said mailbox.

8. A structure as in claim 1, having a second preformed block of rigid lightweight plastic foam material attached to said first block of material, said second block being covered with said one or more coatings of cementitious material and including an upper cutout so as to function as a planter adjacent said mailbox securing first block.

9. A breakaway freestanding roadside structure comprising:

a preformed block of rigid lightweight styrofoam material located on a curbside of a road; cementitious material covering said block and simulating the external appearance of a building facade.

10. A structure as in claim 9, in the form of an entranceway post, wherein said block comprises a first block of generally parallelpiped shape, and further comprising a second block of elongated, tapered shape joined to said first block.

11. A structure as in claim 9, in the form of a fence post, further comprising a cutout extending horizontally at least partially laterally through said block, a length of piping positioned within said cutout, and a rail received within said piping.

12. A method for the construction of a breakaway freestanding roadside structure, comprising the steps of:

mounting a mailbox within a cutout of a preformed block of rigid lightweight plastic foam material;

applying an inner coating of cementitious material to the outside of said block;

applying an outer coating of said cementitious material to the outside of said block over said inner coating; and forming recesses in said outer coating down to said inner coating to simulate by said outer coating the appearance of a plurality of discrete masonry building construction elements and to simulate by exposed portions of said inner coating the appearance of a substance used to bind said elements.

13. A method as in claim 7, further comprising the step of applying color pigmentation to said outer coating to simulate the color of said discrete elements.

14. A method as in claim 13 further comprising the step of applying pigmentation over said outer coating to match the exterior of a building with which the structure will be associated.

15. A method as in claim 13, further comprising the step of applying color pigmentation to said inner coating to simulate the color of a substance used to bind said discrete elements.

16. A method as in claim 15, wherein said outer coating is recessed to simulate the appearance of a plurality of bricks, wherein said pigmentation added to said third coating simulates the color of said bricks, and wherein said pigmentation added to said inner coating simulates the color of mortar in joints between said bricks.

17. A method as in claim 12, wherein said plastic foam material is styrofoam and said cementitious material comprises stucco.

18. A method as in claim 17, wherein said cementitious material comprises a mixture of stucco and lightweight filler material.

19. A method as in claim 12, further comprising applying a base coating of said cementitious material to the outside of said block and allowing said base coating to completely dry; and wherein said inner coating is applied over said dried base coating, said outer coating is applied over said inner coating when said inner coating is only partially dry, and said recesses are formed when said outer coating is still wet.

20. A method as in claim 12, further comprising the steps of:

setting said coated block on the ground at an installation site and marking a boundary outward of the base of said block;

digging out the marked area;

setting said coated block within said dug out area; and installing a collar in the marginal region between said coated block and the edge of said dug out area.

* * * * *

UNITED STATES PATENT AND TRADEMARK OFFICE

CERTIFICATE OF CORRECTION

PATENT NO. : 4,875,622

DATED : October 24, 1989

INVENTOR(S) : Rollie T. Lents

It is certified that error appears in the above-identified patent and that said Letters Patent is hereby corrected as shown below:

Col. 6, line 28, change "7" to --12--.

Signed and Sealed this

Twenty-ninth Day of December, 1992

*Attest:*

DOUGLAS B. COMER

*Attesting Officer*

*Acting Commissioner of Patents and Trademarks*